United States Patent [19]

Yasunaga

[11] Patent Number: 4,688,256

[45] Date of Patent: Aug. 18, 1987

[54] SPEECH DETECTOR CAPABLE OF AVOIDING AN INTERRUPTION BY MONITORING A VARIATION OF A SPECTRUM OF AN INPUT SIGNAL

[75] Inventor: Satoshi Yasunaga, Tokyo, Japan

[73] Assignee: NEC Corporation, Tokyo, Japan

[21] Appl. No.: 564,651

[22] Filed: Dec. 22, 1983

[30] Foreign Application Priority Data

Dec. 22, 1982 [JP] Japan ..... 57-223893

[51] Int. Cl.[4] ..... G10L 5/00

[52] U.S. Cl. ..... 381/46

[58] Field of Search ..... 381/41-50; 364/513.5, 513; 455/222

[56] References Cited

U.S. PATENT DOCUMENTS 4,158,749 6/1979 Deman et al. ..... 381/46

4,401,849 8/1983 Ichikawa et al. ..... 381/46

*Primary Examiner*—E. S. Matt Kemeny

*Attorney, Agent, or Firm*—Sughrue, Mion, Zinn, Macpeak & Seas

[57] ABSTRACT

In a speech presence detector, the input signal (speech plus noise) is detected for power and spectral-variation per unit time. Speech presence is decided if high-power or a sudden large variation in spectral-distribution (for example, unvoiced to voiced sound) is detected.

7 Claims, 2 Drawing Figures

SPEECH DETECTOR CAPABLE OF AVOIDING AN INTERRUPTION BY MONITORING A VARIATION OF A SPECTRUM OF AN INPUT SIGNAL

BACKGROUND OF THE INVENTION

This invention relates to a speech detector responsive to an input signal including a speech or voice signal as a desired signal for detecting presence and absence of the speech signal.

It has already been pointed out that a normal telephone conversation effectively utilizes only about 40% of time on unidirectionally transmitting a speech signal along a transmission line and uselessly wastes the remaining time. Thus, a utilization rate during which the transmission line is effectively utilized is very low in the normal telephone conversation. In order to raise the utilization rate, a speech transmission system has been proposed which can realize effective transmission of the speech signal by transmitting the speech signal only during presence thereof and, otherwise, any other data signals. A speech detector of the type described is used in such a speech transmission system to detect presence and absence of the speech signal.

A conventional speech detector monitors electric power of an input signal to determine presence of the speech signal when the monitored electric power becomes higher than a predetermined or fixed threshold level. Let an ambient noise or background noise be included, as an undesired signal, in the input signal in addition to the speech or desired signal. When the electric power of the input signal is monitored to be compared with the predetermined threshold level, it may always exceed the predetermined threshold level. As a result, the speech detector wrongly detects presence of the speech signal and brings about deterioration of the utilization rate. On the other hand, a higher threshold level gives rise to an interruption at the beginning of each talk or speech. In view of the circumstances, it is possible to adaptively vary a threshold level in response to a level of the undesired signal. However, the interruption at the beginning of each speech inevitably takes place when the level of the undesired signal is equal to or higher than a level of the speech signal.

In IEEE Transactions on Communications, vol. COM-26, No. 1, pp. 140–145 (January, 1978), P. G. Drago et al have proposed a digital dynamic speech detector which detects a speech signal by deriving an envelope of the speech signal to successively monitor relative variations of the envelope between two adjacent time instants. With this speech detector, it is difficult to correctly detect presence of the speech signal when each relative variation is narrow, such as vowels.

In U.S. Pat. No. 4,401,849 issued to Akira Ichikawa et al, a speech detecting method is disclosed which monitors partial auto-correlation coefficients determined in relation to a frequency spectrum of the input signal. The speech detecting method is disadvantageous in that the undesired signal will be erroneously detected as a desired signal when the undesired signal exhibits the partial auto-correlation coefficients which are similar to those of the desired signal.

SUMMARY OF THE INVENTION

It is an object of this invention to provide a speech detector which is capable of reducing wrong detection of a speech signal.

It is another object of this invention to provide a speech detector of the type described, which is capable of avoiding an interruption at the beginning of a speech or talk.

It is a further object of this invention to provide a speech detector of the type described, which is capable of detecting presence of the speech signal even when a level of a background noise is higher than a level of the speech signal.

A speech detector to which this invention is applicable is responsive to an input signal comprising a desired signal and an undesired signal for detecting presence of the desired signal. The desired and the undesired signals are representative of a speech and otherwise, respectively. The input signal has a spectrum variable with time in dependence on the desired and the undesired signals. According to this invention, the detector comprises first means responsive to the input signal for detecting electric power of the input signal to produce a first signal representative of the electric power, second means responsive to the input signal for detecting a variation of the spectrum to produce a second signal representative of the variation, and third means responsive to the first and the second signals for producing a third signal representative of presence of said desired signal.

DESCRIPTION OF THE PREFERRED EMBODIMENTS

Figure 1:
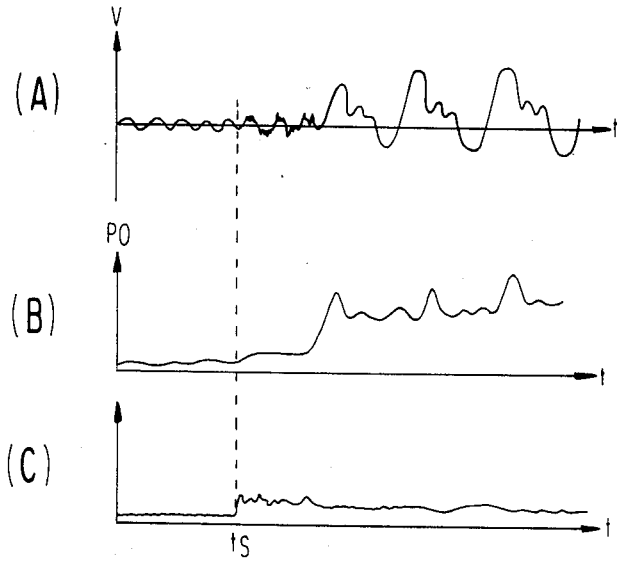
FIG. 1 shows wave-forms for use in describing a principle of this invention.

Referring to FIG. 1, principles of this invention will be described to facilitate an understanding of a speech detector according to this invention. It is assumed that the speech detector is supplied with an input signal IN which has a wave form specified by an input voltage V and includes a speech signal beginning at a start time instant $t_s$, as illustrated in FIG. 1(A). A background or an ambient noise is stationarily included in the illustrated input signal IN, as depicted on the lefthand side of the start time instant $t_s$.

Let electric power $P_0$ be calculated about the input signal IN in a known manner. In this event, the electric power $P_0$ exhibits a power wave form illustrated in FIG. 1(B). The electric power $P_0$ scarcely varies at the start time instant $t_s$. It is therefore difficult to detect the start time instant $t_s$ only by monitoring the electric power $P_0$. This gives rise to an interruption at the beginning of each speech.

Herein, consideration will be directed to that spectrum dispersed within a frequency band and which is specified by spectra of the ambient noise and the speech signal. As is known in the art, the spectrum of the ambient noise would be stationary or invariable with time, if such an ambient noise results from a stationary noise source, such as a motor, or from an electric power source generating a hum. However, it is difficult to preliminarily estimate the spectrum of the ambient noise. Therefore, the speech signal can not be distinguished from the ambient noise even when a plurality of threshold levels are prepared in relation to various different frequencies to monitor each component at the respective frequencies. On the other hand, the spectrum of the speech signal is nonstationary at the beginning of each speech and, therefore, exhibits a transient spectrum thereat. Such a transient spectrum is conspicuous particularly in fricative consonants. The transient spectrum does not appear during continuation of single sounds, such as vowels. In this case, it is possible to distinguish between the ambient noise and the beginning of each speech by monitoring the transient spectrum. Under the circumstances, a variation of the spectrum of the input signal IN is successively detected in the form of a variation of electric power relating to the spectrum. The variation of electric power may be a difference between electric power derived at two adjacent time instants. The difference of electric power varies as illustrated in FIG. 1(C) and exhibits a steep variation at the start time instant $t_s$. Thus, the steep variation results from the transient spectrum.

The spectrum of the input signal IN, namely, the electric power relating to the spectrum can be specified at each time instant by each partial autocorrelation coefficient calculated at each time instant, in the manner known in the art. Taking the above into account, operation is carried out in the speech detector to successively calculate the partial autocorrelation coefficients at the respective time instants and to obtain differences between the partial autocorrelation coefficients calculated at two adjacent ones of the time instants.

Let only the differences between the partial autocorrelation coefficients be monitored and detected to produce an output signal representative of presence of the speech signal. In this event, those of the vowels which include continuation of single sounds may objectionably be lost from the output signal.

The speech detector according to this invention detects not only the differences between the partial autocorrelation coefficients but also the electric power illustrated in FIG. 1(B). Therefore, both of the beginning of each speech and the vowels can correctly be detected by the speech detector. Any other coefficients or factors may be monitored instead of the partial autocorrelation coefficients in order to successively detect the spectrum at two adjacent ones of the time instants.

Figure 2:
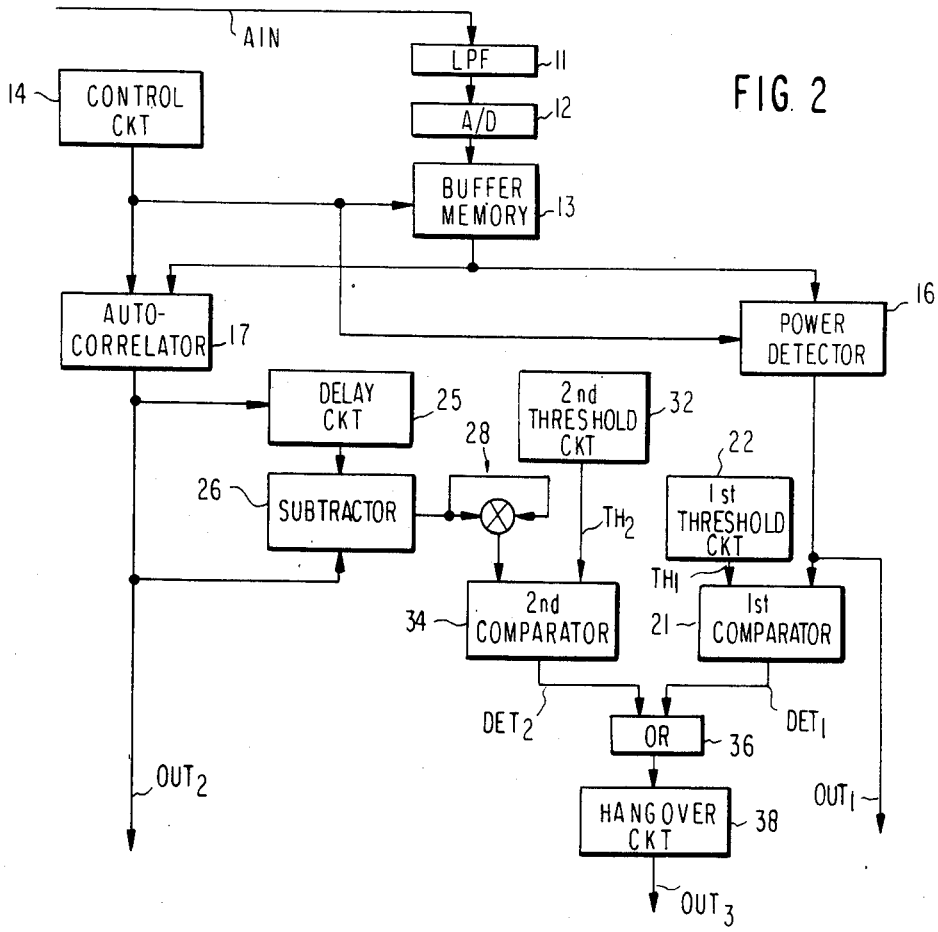
FIG. 2 shows a block diagram of a speech detector according to a preferred embodiment of this invention.

Referring to FIG. 2, a speech detector according to a preferred embodiment of this invention is operable in response to an analog input signal AIN to deliver first, second, and third output signals OUT1, OUT2, and OUT3 (as will become clear later) to a speech synthesis unit (not shown). The analog input signal AIN is supplied through a low pass filter (LPF) 11 to an analog-to-digital (A/D) converter 12 to be converted into a succession of digital signals.

The digital signal succession is processed at each frame having a frame period shorter than 30 milliseconds. The frame period is, for example, 20 milliseconds. The digital signal succession is sent to a buffer memory 13 having a first and a second memory section (not shown). The digital signal succession is alternatingly distributed to the first and the second memory sections at each frame period under control of the control circuit 14. The stored digital signal succession is selectively read out of the first and the second memory sections by the control circuit 14 to be delivered to a power detector 16 and an autocorrelator 17 in parallel. The power detector 16 and the autocorrelator 17 are synchronously put into operation by the control circuit 14 so as to process the read out digital signal succession. The read out digital signal succession is processed in a manner similar to the input signal IN described in conjunction with FIG. 1. The read out digital signal succession may be regarded as the input signal IN described in FIG. 1.

The power detector 16 may be a multiplier for successively calculating a square of each digital signal. The square of each digital signal specifies electric power of each digital signal. The power detector 16 therefore produces a first power signal representing the square of each digital signal to specify the electric power. The first power signal is sent to a first comparator 21 and to the speech synthesis unit as the first output signal OUT1. A first threshold circuit 22 produces a first threshold signal TH1 representative of a first threshold level predetermined in relation to the electric power of each digital signal. The first comparator 21 compares the first power signal with the first threshold signal TH1 to produce a first signal representative of a result of comparison. A combination of the power detector 16, the first comparator 21, and the first threshold circuit 22 serves as a first detection circuit for detecting the electric power of each digital signal and, therefore, the first signal may be called a first detection signal DET1 representative of a result of the above-mentioned detection.

It should be noted here that the first comparator 21 itself need not avoid an interruption occurring at the beginning of each speech. The first threshold level is therefore selected at a comparatively high level in which the interruption may occur at the beginning of each speech.

Responsive to the digital signal succession read out of the buffer memory 13, the autocorrelator 17 calculates a partial autocorrelation coefficient dependent on the spectrum. The partial autocorrelation coefficient may be either a first-order partial autocorrelation coefficient or a second-order partial autocorrelation coefficient. Such calculation of a partial autocorrelation coefficient is readily possible in a well-known circuit. Therefore, the autocorrelator 17 will not be described in detail herein. Anyway, the autocorrelator 17 produces a succession of coefficient signals each of which is representative of the partial autocorrelation coefficient.

The coefficient signal succession is delivered to a delay circuit 25 and a subtractor 26. The coefficient signal succession is furthermore delivered to the speech synthesis unit as the second output signal OUT2. The second output signal OUT2 is processed by the speech synthesis unit in a known manner. The delay circuit 25 provides a predetermined delay to the coefficient signal succession to produce a succession of delayed coefficient signals. The predetermined delay is equal to the frame period.

The subtractor 26 successively subtracts the delayed coefficient signal succession from the coefficient signal succession to calculate a difference between each delayed signal and each coefficient signal to produce a difference signal representative of the difference. Inasmuch as each delayed signal is delayed by the frame period, the difference specifies a variation between two adjacent ones of the frames. The difference signal is sent to a power calculator 28 which may be a multiplier and which is similar to the power detector 16. The power calculator 28 calculates a square of the difference to produce a square signal representative of the square.

The square signal specifies additional electric power determined by the variation of the spectrum, namely, by the difference of two adjacent ones of the partial autocorrelation coefficients. Thus, the square signal has a variable level in accordance with the difference.

A second threshold circuit 32 produces a second threshold signal TH2 representative of a second threshold level predetermined in relation to the additional electric power. The second threshold level is selected such that the beginning of each speech can be detected when the square signal succession is monitored.

A second comparator 34 compares the square signal succession with the second threshold signal TH2 to produce a second signal indicative of comparison. A combination of the autocorrelator 17, the delay circuit 25, the subtractor 26, the power detector 28, the second threshold circuit 32, and the second comparator 34 serves as a second detection circuit for detecting the variation of the spectrum. In this connection, the second signal may be called a second detection signal DET2 representative of the variation of the spectrum. In the second detection circuit, the power calculator 28, the second threshold circuit 32, and the second comparator 34 are operable to derive the additional electric power, specifying the variation, from the difference signal succession.

The first and the second detection signals DET1 and DET2 are sent through an OR gate 36 to a hangover circuit 38. The hangover circuit 38 provides a delay to a signal passing through the OR gate 36 in a known manner to produce a third signal representative of presence of the speech signal. The hangover circuit 38 serves to avoid objectionable abrupt interruptions or pauses. Such a hangover circuit 38 may be structured by a counter or the like. The delayed signal is supplied from the hangover circuit 38 to the speech synthesis unit as the third output signal OUT3.

While this invention has thus far been described in conjunction with a preferred embodiment of this invention, it will readily be possible for those skilled in the art to put this invention into practice in various manners. For example, any other factors which specify the spectrum may be used instead of the partial autocorrelation coefficients. The spectrum may be divided into a plurality of partial spectra so as to detect the difference of the spectrum by monitoring the partial spectra as the factors. The first and the second threshold levels may adaptively be varied in response to the input signal.

What is claimed is:

1. A speech detector responsive to an electrical input signal, said input signal comprising a speech signal representing speech and a further signal, for detecting presence of said speech signal, said input signal having electric power and having a spectrum representing an energy distribution of said input signal, said spectrum being variable with time in dependence on said speech and further signals, said detector comprising:

first means responsive to said input signal for detecting said electric power of said input signal to produce a first signal representative of said electric power;

second means responsive to said input signal for detecting a variation of said spectrum over time to produce a second signal representative of said variation; and third means responsive to said first and said second signals for producing a third signal representative of presence of said speech signal.

2. A speech detector as claimed in Claim 1, wherein said second means comprises:

first calculation means responsive to said input signal at successive time points for calculating a predetermined value dependent on said spectrum to produce a succession of first calculation means output signals representative of said predetermined value;

delay means coupled to said first calculation means for providing a preselected delay to said first calculation means output signal succession to produce a succession of delayed first calculation means output signals;

difference calculating means coupled to said first calculation means and said delay means for successively calculating a succession of differences between said first calculation means output signals and said delayed first calculation means output signals to produce a succession of difference signals each having electric power and each representative of said differences;

variation calculating means coupled to said difference calculating means for calculating the electric power of said difference signals to produce a further power signal representative of said electric power of said difference signals; and means for producing said further power signal as said second signal.

3. A speech detector as claimed in claim 2, wherein said variation calculating means comprises:

a power calculator responsive to each of said difference signals for successively calculating squares of the respective differences to produce a succession of fourth signals which are representative of said squares;

threshold signal producing means for producing a threshold signal representative of a predetermined threshold level; and comparing them for comparing each fourth signal with said threshold level to produce said second signal.

4. A speech detector as claimed in claim 2, wherein said predetermined value is a partial autocorrelation coefficient

5. A speech detector as claimed in claim 1, wherein said third means comprises:

means for providing a delay to at least one of said first and said second signals to produce said third signal.

6. A speech detector as claimed in claim 1, wherein said further signal represents noise.

7. A speech detector as claimed in claim 1, wherein said second means detects the amount of said variation between successive time points.

* * * * *

UNITED STATES PATENT AND TRADEMARK OFFICE

CERTIFICATE OF CORRECTION

PATENT NO. : 4,688,256

DATED : August 18, 1987

INVENTOR(S) : SATOSHI YASUNAGA, Tokyo, Japan

It is certified that error appears in the above-identified patent and that said Letters Patent is hereby corrected as shown below:

Column 6, line 47, change "them" to --mean--.

Signed and Sealed this

Sixteenth Day of August, 1988

*Attest:*

*Attesting Officer*

DONALD J. QUIGG

*Commissioner of Patents and Trademarks*